US008733865B1

(12) United States Patent
Chambers et al.

(10) Patent No.: US 8,733,865 B1
(45) Date of Patent: May 27, 2014

(54) UNDERMOUNT SLIDE FOR PULL-OUT DRAWER

(71) Applicant: Rev-A-Shelf Company LLC, Jeffersontown, KY (US)

(72) Inventors: Paul F. Chambers, Louisville, KY (US); David P. Noe, Louisville, KY (US)

(73) Assignee: Rev-A-Shelf Company LLC, Jeffersontown, KY (US)

( * ) Notice: Subject to any disclaimer, the term of this patent is extended or adjusted under 35 U.S.C. 154(b) by 0 days.

(21) Appl. No.: 13/799,438

(22) Filed: Mar. 13, 2013

(51) Int. Cl.
*A47B 88/00* (2006.01)

(52) U.S. Cl.
USPC ..... 312/334.24; 312/334.28; 312/334.32

(58) Field of Classification Search
USPC ..... 312/334.23–334.35, 198, 201
See application file for complete search history.

(56) References Cited

U.S. PATENT DOCUMENTS 1,513,596 A * 10/1924 Judelson ..... 211/94.03
1,853,061 A * 4/1932 Judelson ..... 34/664
2,885,694 A * 5/1959 Ulm ..... 5/308
2,923,584 A * 2/1960 Broderick, Jr. ..... 312/317.1
5,070,556 A * 12/1991 Gloger ..... 5/308
5,118,177 A * 6/1992 Ryczek ..... 312/334.26
5,967,346 A * 10/1999 Price, Jr. ..... 211/162
8,567,883 B2 * 10/2013 Hsiao ..... 312/249.8
2002/0140328 A1 * 10/2002 Dressendorfer et al. . 312/334.23
2010/0102689 A1 * 4/2010 Chambers et al. ..... 312/257.1
2012/0104918 A1 * 5/2012 Peng et al. ..... 312/334.27

* cited by examiner

*Primary Examiner* — Hanh V Tran
(74) *Attorney, Agent, or Firm* — Brinks Gilson & Lione

(57) ABSTRACT

A drawer slide system can include a frame comprising a top portion. The top portion can have an inside facing surface and an outside facing surface. The drawer slide system can also include a drawer comprising a top portion. The top portion can have an inside facing surface and an outside facing surface. The inside facing surface of the top portion of the frame can be adjacent to the outside facing surface of the top portion of the drawer. The drawer slide system can further include a longitudinally extendable top drawer slide comprising a fixed portion and a movable portion. The movable portion of the top drawer slide can be coupled to the inside facing surface of the top portion of the drawer. The drawer slide system can also include a bracket coupled to the fixed portion of the top drawer slide and to the top portion of the drawer.

15 Claims, 5 Drawing Sheets

UNDERMOUNT SLIDE FOR PULL-OUT DRAWER

BACKGROUND

1. Technical Field

The present disclosure relates to side access drawers, useful on pull-outs from cabinets, and more particularly relates to drawer slides for side access drawers.

2. Background Information

Most drawers typically consist of a bottom surrounded by four upright members defining a back wall, two side walls, and a drawer front. The contents of the drawer can be accessed through an open horizontal plane defined generally by the upper margins of the back wall and two side walls. To facilitate such access, a drawer slide can be coupled to each side of the drawer and to each side of the drawer receiving opening in the cabinet holding the drawer. Each drawer slide consists generally of a first rail that is designed to be fixed to the side of the drawer and a second rail that is designed to be fixed to the cabinet. The first and second rails are coupled to each other by inter-engaging surfaces such a glides or bearings that facilitate relative movement between the two rails. A wide variety of such drawer slides exist that are suitable for use to permit drawers to move smoothly and easily in and out of cabinetry, particularly cabinetry typically found in kitchens.

Some drawers have a much different construction from that previously described. In particular, some drawers consist of a bottom, a back wall, a drawer front and one or more shelves or racks connected between the back wall and the drawer front. Access to the shelves or racks is gained through either of two vertical planes located on either side of the drawer and defined generally by the lateral margins of the back wall and bottom. In view of the desirability of maximizing the side access to such drawers, the use of side-mounded drawer slides is undesirable. As a result, some installations involve the use of a drawer slide mounted between the bottom of the side access drawer and the drawer receiving opening in the cabinet holding the drawer. If the side access drawer is much taller than it is wide, the drawer can exhibit significant vertical instability. To enhance the vertical stability of the side access drawer, another slide or guide is typically placed between the top of the back wall and the drawer front and coupled to the top of the drawer receiving opening in the cabinet holding the drawer. Examples of this construction are to be found, for example, in U.S. Pat. Nos. 6,199,966; 6,412,892; and 6,682,159. While this top slide or guide works satisfactorily to stabilize the side access drawer, it can be difficult to install and align the top and bottom slides to the cabinet.

BRIEF SUMMARY

A drawer slide system can include a frame comprising a top portion. The top portion can have an inside facing surface and an outside facing surface. The drawer slide system can also include a drawer comprising a top portion. The top portion can have an inside facing surface and an outside facing surface. The inside facing surface of the top portion of the frame can be adjacent to the outside facing surface of the top portion of the drawer. The drawer slide system can further include a longitudinally extendable top drawer slide comprising a fixed portion and a movable portion. The movable portion of the top drawer slide can be coupled to the inside facing surface of the top portion of the drawer. In addition, the drawer slide system can include a bracket coupled to the fixed portion of the top drawer slide and to the top portion of the drawer.

DETAILED DESCRIPTION OF THE PREFERRED EMBODIMENTS

Figure 1:
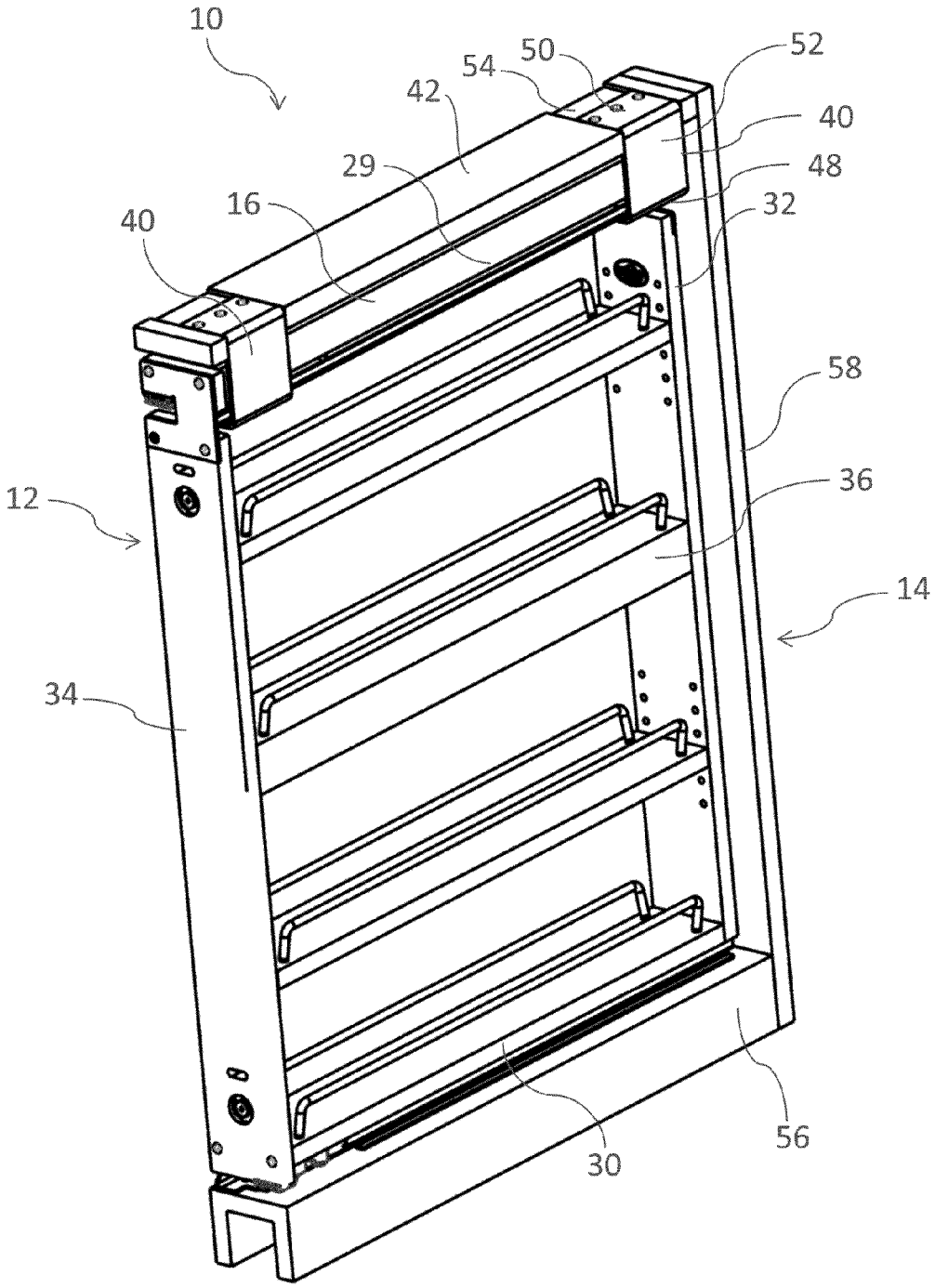
FIG. 1 is a perspective view of a drawer slide system having a side access drawer in accordance with certain embodiments disclosed herein.
Figure 2:
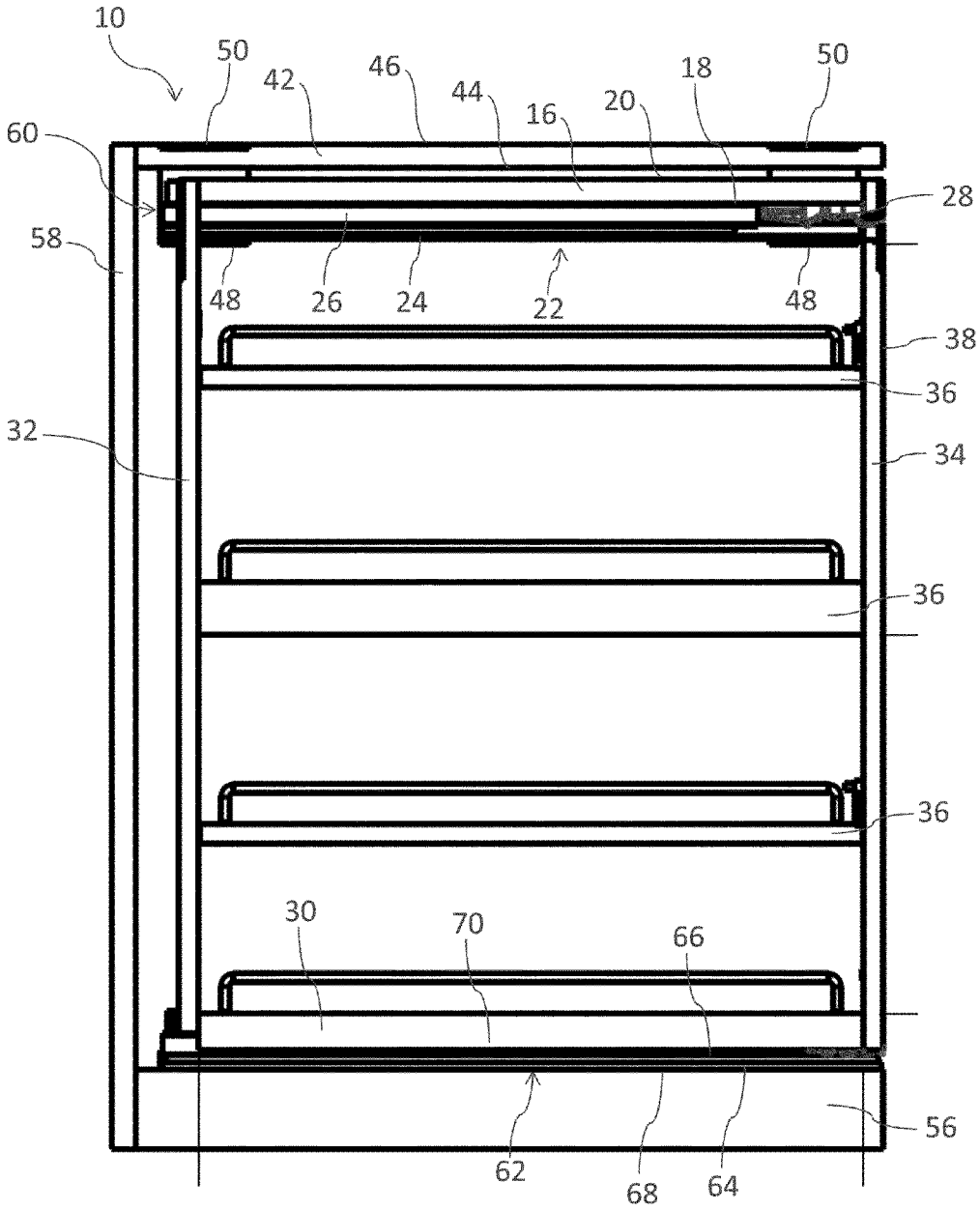
FIG. 2 is a side view of the drawer slide system of FIG. 1.
Figure 3:
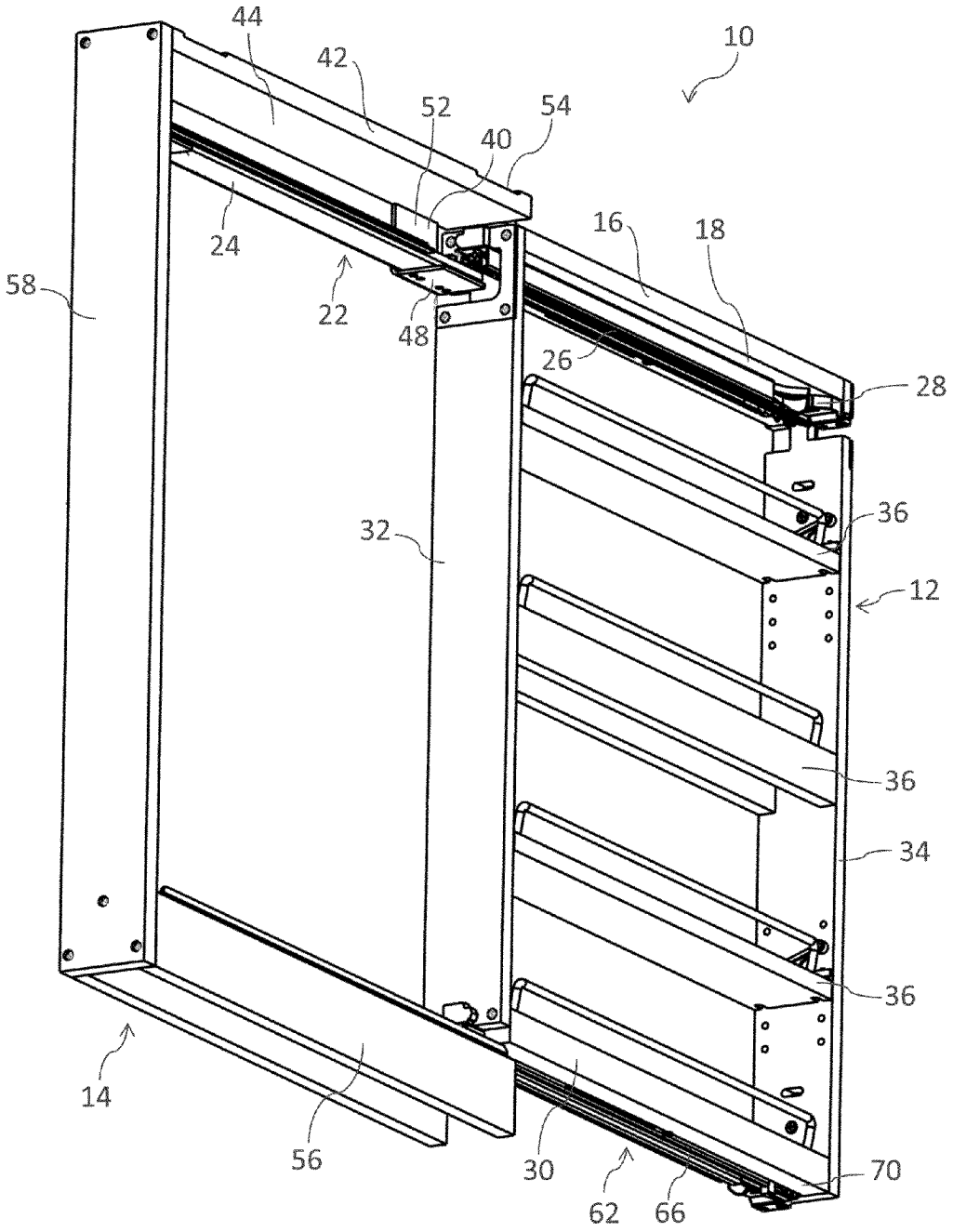
FIG. 3 is a bottom perspective view of the drawer slide system of FIG. 1 where the drawer is slid out from the frame.
Figure 4:
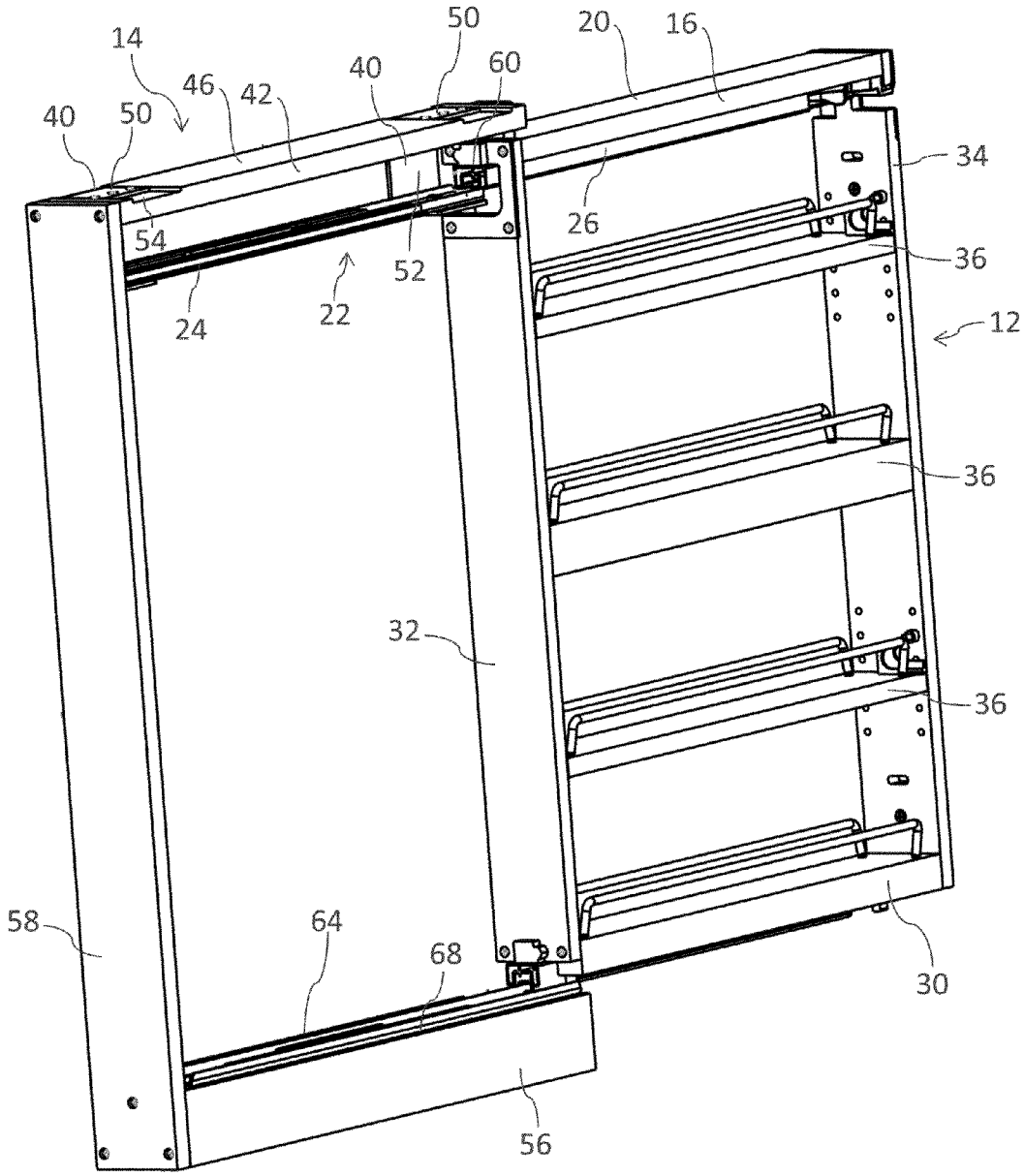
FIG. 4 is a top perspective view of the drawer slide system of FIG. 1 where the drawer is slid out from the frame.

FIGS. 1-4 show a drawer slide system 10 in a closed position. The drawer slide system 10 can be installed between two cabinets to provide pull-out storage space with one or more shelves. For example, the drawer slide system 10 can include a side-access drawer.

The drawer slide system 10 includes a drawer 12 and a frame 14. The drawer 12 can move longitudinally relative to the frame 14. For example, the frame 14 can be mounted between two cabinets and the drawer 12 can move longitudinally relative to the cabinet so that the drawer 12 can move between an open position and a closed position. As described further below, the combination of the drawer 12 and the frame 14 can make installation of the drawer slide system 10 quicker and easier than certain conventional side-access drawers.

The drawer 12 includes a top portion 16. The top portion 16 has an inside facing surface 18 and an outside facing surface 20. The drawer slide system 10 also includes a longitudinally extendable top drawer slide 22 comprising a fixed portion 24 and a movable portion 26. The movable portion 26 of the top drawer slide 22 is coupled to the inside facing surface 18 of the top portion 16 of the drawer 12. The top drawer slide 22 can be coupled to the top portion 16 by a variety of means such as by screws or fasteners. Furthermore, the top portion 16 can be removable from the top drawer slide 22. For example, the top drawer slide 22 can include a releasable locking mechanism 28 such as part numbers T51.0700.20.L and T51.0700.20.R from Blum Inc., Stanley, N.C. for a drawer slide system 10 that is about 3 inches wide and part numbers T51.1700.04.L and T51.1700.04.R from Blum Inc. for a drawer slide system 10 that is about 6 inches wide.

The top portion 16 can also include a protrusion 29 extending longitudinally along the inside facing surface 18. The protrusion 29 can be adjacent to a side of the movable portion 26 of the top drawer slide 22 to provide alignment of the movable portion 26 of the top drawer slide 22 with respect to the top portion 16. For example, the protrusion 29 can be substantially parallel with top portion 16, and therefore, the movable portion 26 of the top drawer slide 22 can be aligned to be substantially parallel with the top portion 16. Protrusions 29 can also be adjacent to both sides of the movable portion 26 of the top drawer slide 22 and not just one side.

The drawer 12 can further include a bottom portion 30. A back portion 32 can extend from the top portion 16 to the bottom portion 30. A front portion 34 can also extend from the top portion 16 to the bottom portion 30. The top portion 16, bottom portion 30, back portion 32 and front portion 34 can form the outer surface of the drawer 12. The height of the drawer 12 can be greater than the width of the drawer 12. Alternatively, the width of the drawer 12 can be greater than the height of the drawer 12.

One or more shelves 36 can extend from the back portion 32 to the front portion 34, and the shelves 36 can be spaced from one another vertically. In addition, one or more of the shelves 36 can be vertically adjustable. Furthermore, the bottom portion 30 can be a shelf 36.

A decorative surface such as a door can be mounted onto the outside facing surface 38 of the front portion 34. The decorative surface can be adjustable so that the decorative surface can be aligned with adjacent cabinets. For example, the decorative surface can be mounted to the front portion 34 with fasteners or screws that provide vertical and horizontal adjustment of the decorative surface relative to the front portion 34. In addition, the front portion 34 can include a set screw to adjust tilt of the decorative surface relative to the front portion 34.

One or more brackets 40 are coupled to the fixed portion 24 of the top drawer slide 22. For example, two brackets 40 are shown in FIGS. 1-4 with one bracket 40 at the front end of the fixed portion 24 and another bracket 40 at the back end of the fixed portion 24 of the top drawer slide 22. Furthermore, the brackets 40 are also coupled to a top portion 42 of the frame 14. For example, at least two brackets 40 can be spaced apart from one another longitudinally along the top portion 42 of the frame 14.

The top portion 42 of the frame 14 has an inside facing surface 44 and an outside facing surface 46. The inside facing surface 44 of the top portion 42 of the frame 14 is adjacent to the outside facing surface 20 of the top portion 16 of the drawer 12. The top portion 16 of the drawer 12 and the top portion 42 of the frame 14 can be substantially parallel to each other and extend longitudinally. When installed, the top portion 16 of the drawer 12 and the top portion 42 of the frame 14 can be horizontal to the floor.

Figure 5:
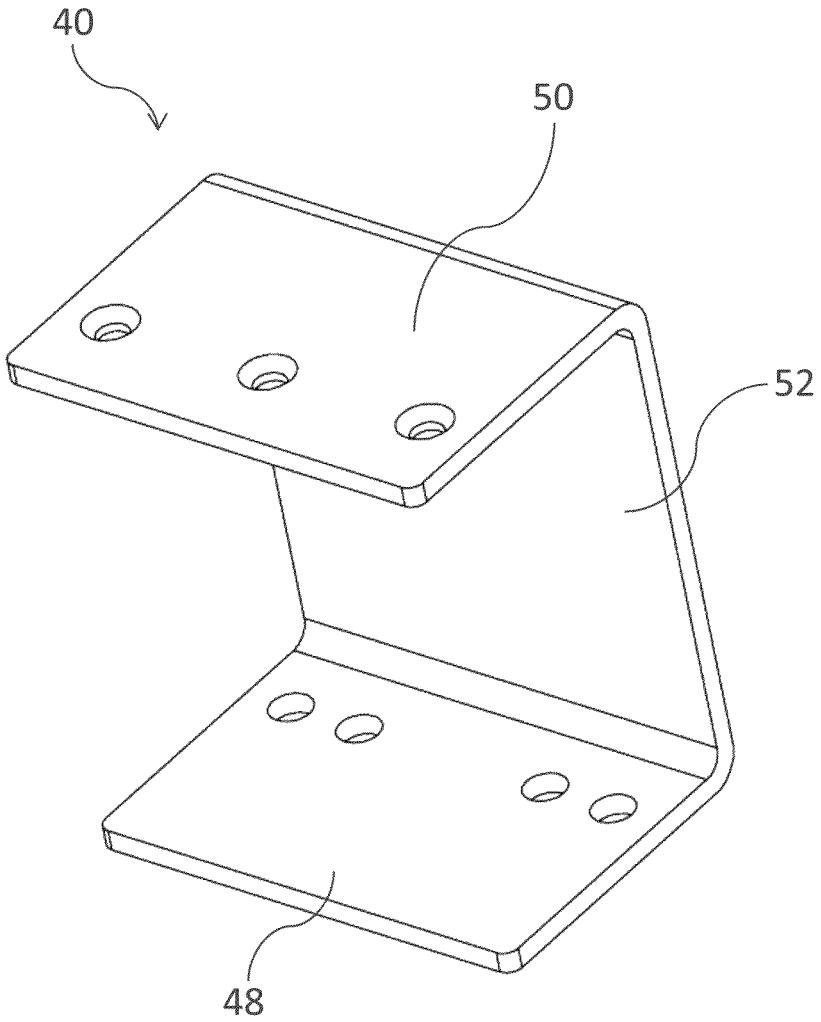
FIG. 5 is a perspective view of a bracket in accordance with certain embodiments disclosed herein.

As discussed above, the brackets 40 can extend from the fixed portion 24 of the top drawer slide 22 to the top portion 42 of the frame 14. For example, as shown in FIG. 5, the brackets 40 can include a first horizontal portion 48, a second horizontal portion 50, and a vertical portion 52 extending between the first horizontal portion 48 and the second horizontal portion 50. The first horizontal portion 48 can be coupled to a bottom portion of the fixed portion 24 of the top drawer slide 22, and the second horizontal portion 50 can be coupled to the outside facing surface 46 such as a top facing surface of the top portion 42 of the frame 14. The second horizontal portion 50 can be recessed within a groove 54 of the outside facing surface 46 of the top portion 42 of the frame 14 so that the second horizontal portion 50 is flush with or below the top of the outside facing surface 46. Having the second horizontal portion 50 recessed within the outside facing surface 46 can facilitate installation of the top portion 42 to a cabinet. Similarly, the groove 54 can be further formed in a side of the top portion 42 of the frame 14 so that the vertical portion 52 is flush with or below the surface of the side of the top portion 42.

The frame 14 can further include a bottom portion 56. A back portion 58 of the frame 14 can couple to and extend between the top portion 42 and the bottom portion 56 of the frame 14. The back portion 58 of the frame 14 can be adjacent to the back portion 32 of the drawer 12. When installed, the bottom portion 56 can be, for example, on a floor with the top portion 42 coupled to top of a cabinet and can be under a countertop. The back portion 58 can be adjacent to a wall.

Various types of drawer slides can be used for the top drawer slide 22. For example, the top drawer slide 22 can be soft-close type slide such as part numbers 568RS331B-L and 568RS331B-R from Blum Inc. The top drawer slide 22 can be configured to restrict speed that the drawer 12 moves as the drawer 12 moves into a closed position within the frame 14. Furthermore, the top drawer slide 22 can extend though an opening 60 in the back portion 32 to enable further range of longitudinal movement of the drawer 12 relative to the frame 14.

The drawer slide system 10 can further include a longitudinally extendable bottom drawer slide 62 comprising a fixed portion 64 and a movable portion 66. The fixed portion 64 of the bottom drawer slide 62 is coupled to an inside surface 68 of the bottom portion 56 of the frame 14. The movable portion 66 of the bottom drawer slide 62 is coupled to an outside surface 70 of the bottom portion 30 of the drawer 12. The bottom drawer slide 62 can include any features as those discussed above with regard to the top drawer slide 22 such as being a soft-close type or including a releasable locking mechanism. For example, part numbers 568RS331B-L and 568RS331B-R from Blum Inc. can be used as the bottom drawer slide 62. Furthermore, the bottom portion 32 can include a protrusion, similar to the protrusion 29 of the top portion 16, extending longitudinally along the outside surface 70 to provide alignment of the movable portion 66 of the bottom drawer slide 62. The combination of the top drawer slide 22 and the bottom drawer slide 62 can provide longitudinal movement of the drawer 12 relative to the frame 14 that is stable and smooth.

Advantageously, the drawer 12 and the frame 14 can be provided together. The frame 14 can be installed into a cabinet or between adjacent cabinets, and the drawer 12 can then be inserted into the frame 14. Since the frame 14 can include both the fixed portion 24 of the top drawer slide 22 and the fixed portion 64 of the bottom drawer slide 62, installation can be quicker and easier since the installer does not need to align the top drawer slide 22 relative to the bottom drawer slide 62.

Other variations in dimension will become apparent to those skilled in the art that are still within the scope of the invention as defined in the following claims. The foregoing detailed description should be regarded as merely illustrative rather than limiting, and the following claims, including all equivalents, are intended to define the spirit and scope of this invention.

The invention claimed is:

1. A drawer slide system comprising:

a frame comprising a top portion, the top portion having an inside facing surface and an outside facing surface;

a drawer comprising a top portion and a back portion coupled to and extending from the top portion, the top portion having an inside facing surface and an outside facing surface, the inside facing surface of the top portion of the frame being adjacent to the outside facing surface of the top portion of the drawer;

a longitudinally extendable top drawer slide comprising a fixed portion and a movable portion, the movable portion of the top drawer slide coupled to the inside facing surface of the top portion of the drawer; and a bracket coupled to the fixed portion of the top drawer slide and to the outside facing surface of the frame, wherein the back portion of the drawer comprises an opening that the top drawer slide extends at least partially through.

2. The drawer slide system of claim 1, further comprising:

a longitudinally extendable bottom drawer slide comprising a fixed portion and a movable portion, wherein the frame further comprises a bottom portion, the fixed portion of the bottom drawer slide coupled to the bottom portion of the frame, and the drawer further comprises a bottom portion, the movable portion of the bottom drawer slide coupled to the bottom portion of the drawer.

3. The drawer slide system of claim 1, wherein a section of the bracket is within a groove of the outside facing surface of the top portion of the frame.

4. The drawer slide system of claim 1, wherein the bracket comprises a first horizontal portion, a second horizontal portion, and a vertical portion extending between the first horizontal portion and the second horizontal portion, wherein the first horizontal portion is coupled to a bottom portion of the fixed portion of the top drawer slide, and the second horizontal portion is coupled to the outside facing surface of the top portion of the frame.

5. The drawer slide system of claim 1, wherein the bracket comprises at least two brackets spaced apart from one another longitudinally along the top portion of the frame.

6. The drawer slide system of claim 1, wherein the frame comprises a back portion coupled to and extending between the top portion and a bottom portion of the frame.

7. The drawer slide system of claim 1, wherein the back portion couples to and extends between the top portion and a bottom portion of the drawer; and a front portion coupled to and extending between the top portion and the bottom portion of the drawer.

8. The drawer slide system of claim 7, wherein drawer comprises a plurality of shelves extending from the back portion to the front portion of the drawer, and the shelves spaced from one another vertically.

9. The drawer slide system of claim 7, wherein the frame comprises a back portion coupled to and extending between the top portion and a bottom portion of the frame, and the back portion of the frame being adjacent to the back portion of the drawer.

10. The drawer slide system of claim 7, wherein the bottom portion of the drawer comprises a shelf.

11. The drawer slide system of claim 1, wherein the drawer comprises a height and a width, and the height is greater than the width.

12. The drawer slide system of claim 1, wherein the top portion of the drawer and the top portion of the frame are substantially parallel and extend longitudinally.

13. The drawer slide system of claim 1, wherein the top portion of the drawer comprises a protrusion extending longitudinally adjacent to a side of the movable portion of the top drawer slide.

14. The drawer slide system of claim 1, wherein the top drawer slide is configured to restrict speed that the drawer moves as the drawer moves into a closed position.

15. The drawer slide system of claim 1, wherein the top drawer slide includes a releasable locking mechanism.

* * * * *